US011629311B2

(12) United States Patent
Smith et al.

(10) Patent No.: US 11,629,311 B2
(45) Date of Patent: Apr. 18, 2023

(54) ENHANCED SOLUBILIZATION USING A COMBINATION OF EXTENDED CHAIN SURFACTANTS

(71) Applicant: Indorama Ventures Oxides LLC, The Woodlands, TX (US)

(72) Inventors: George Smith, Montgomery, TX (US); Gary R. Watkins, Rohnert Park, CA (US)

(73) Assignee: Indorama Ventures Oxides LLC, The Woodlands, TX (US)

( * ) Notice: Subject to any disclaimer, the term of this patent is extended or adjusted under 35 U.S.C. 154(b) by 0 days.

(21) Appl. No.: 15/778,669

(22) PCT Filed: Mar. 9, 2017

(86) PCT No.: PCT/US2017/021585

§ 371 (c)(1),
(2) Date: May 24, 2018

(87) PCT Pub. No.: WO2017/172320

PCT Pub. Date: Oct. 5, 2017

(65) Prior Publication Data

US 2019/0010422 A1 Jan. 10, 2019

Related U.S. Application Data

(60) Provisional application No. 62/316,203, filed on Mar. 31, 2016.

(51) Int. Cl.

| | |
|---|---|
| ***C11D 1/831*** | (2006.01) |
| ***C11D 1/29*** | (2006.01) |
| ***C11D 1/72*** | (2006.01) |
| ***C11D 17/00*** | (2006.01) |
| ***C11D 1/83*** | (2006.01) |
| *C11D 11/00* | (2006.01) |

(52) U.S. Cl.
CPC ..... *C11D 1/831* (2013.01); *C11D 1/29* (2013.01); *C11D 1/72* (2013.01); *C11D 1/83* (2013.01); *C11D 17/0021* (2013.01); *C11D 11/0017* (2013.01); *C11D 11/0023* (2013.01)

(58) Field of Classification Search
CPC ..... C11D 1/831; C11D 1/29; C11D 17/0021; C11D 11/0017; C11D 11/0023
See application file for complete search history.

(56) References Cited

U.S. PATENT DOCUMENTS

| | | | | |
|---|---|---|---|---|
| 3,875,202 | A | 4/1975 | Steckler | |
| 4,464,292 | A | 8/1984 | Lengyel | |
| 4,608,197 | A * | 8/1986 | Kesling, Jr. | C07C 305/00 510/537 |
| 5,076,954 | A | 12/1991 | Loth et al. | |
| 5,411,674 | A * | 5/1995 | Tagata | C11D 10/04 510/340 |
| 6,117,915 | A * | 9/2000 | Pereira | A61K 8/068 516/57 |
| 7,387,991 | B2 * | 6/2008 | Hudson | C11D 1/65 510/119 |
| 7,467,633 | B2 | 12/2008 | Smith et al. | |
| 8,034,757 | B2 * | 10/2011 | Murata | C11D 1/83 510/340 |
| 8,172,953 | B2 | 5/2012 | Hodge et al. | |
| 8,454,709 | B2 | 6/2013 | Man et al. | |
| 8,697,622 | B2 | 4/2014 | Man et al. | |
| 9,034,813 | B2 | 5/2015 | Man et al. | |
| 10,316,276 | B2 * | 6/2019 | Hellmuth | C11D 7/265 |
| 2005/0119146 | A1 * | 6/2005 | Rodrigues | C11D 1/008 510/224 |
| 2006/0211593 | A1 * | 9/2006 | Smith | C11D 1/83 510/424 |
| 2008/0207939 | A1 * | 8/2008 | Tropsch | A61K 8/463 558/34 |
| 2010/0305254 | A1 * | 12/2010 | Ikenaga | C08F 2/26 524/156 |
| 2012/0066840 | A1 * | 3/2012 | Man | C11D 1/83 510/276 |
| 2012/0070388 | A1 | 3/2012 | Man | |
| 2012/0071384 | A1 | 3/2012 | Christensen | |
| 2015/0051132 | A1 | 2/2015 | Li et al. | |

FOREIGN PATENT DOCUMENTS

| | | | |
|---|---|---|---|
| JP | 2001-172671 | A | 6/2001 |
| JP | 2015-025062 | A | 2/2015 |
| WO | 1991013057 | A | 9/1991 |
| WO | 2014134826 | A1 | 9/2014 |
| WO | 2015085509 | A1 | 6/2015 |

* cited by examiner

*Primary Examiner* — Necholus Ogden, Jr.
(74) *Attorney, Agent, or Firm* — Indorama Ventures Oxides, LLC

(57) ABSTRACT

The present disclosure provides a surfactant blend containing (i) an extended chain anionic surfactant and (ii) an extended chain intermediate surfactant. The surfactant blend may be used in the preparation of cleaning compositions, or compositions for use in oil field treatment applications, water based metal working applications and polyurethane foam applications.

12 Claims, No Drawings

ENHANCED SOLUBILIZATION USING A COMBINATION OF EXTENDED CHAIN SURFACTANTS

CROSS REFERENCE TO RELATED APPLICATIONS

This application is a National Stage Application filed under 35 U.S.C. § 371 of International Application Number PCT/US2017/021585, filed Mar. 9, 2017, which claims the benefit of U.S. Provisional Patent Application Ser. No. 62/316,203, filed Mar. 31, 2016, the entire contents of which are expressly incorporated herein by reference.

STATEMENT REGARDING FEDERALLY SPONSORED RESEARCH OR DEVELOPMENT

Not applicable.

FIELD OF THE INVENTION

The present disclosure provides a surfactant blend comprising an extended chain anionic surfactant and an extended chain intermediate surfactant and its use in various applications, such as in household and industrial-institutional cleaning products, personal care and metal working.

BACKGROUND

Extended chain surfactants are surfactants in which groups of intermediate polarity, such as polypropylene oxides or copolymers of propylene oxides and ethylene oxides, are inserted between the hydrocarbon tail and hydrophilic head group. Due to the resulting molecular structure, the surfactant extends further into both the oil and water phases, resulting in a greater interaction between the 2 phases and providing a smoother transition between the hydrophilic and hydrophobic regions of the interface. This provides a more suitable environment for solubilizing hydrophilic and lipophilic molecules.

State of the art extended chain surfactants and their use in various applications include, for example:

U.S. Pat. No. 9,034,813 which discloses a soaking composition containing a positively charged polyethyleneimine (PEI) polymer and an extended chain anionic surfactant;

U.S. Pat. No. 8,697,622 which discloses a cleaning composition containing an extended chain nonionic surfactant and a linker co-surfactant including mono- and di-glycerides, and/or fatty acids and fatty diacids;

U.S. Pat. No. 8,454,709 which discloses an extended chain anionic surfactant, a linker such as amine oxide or dioctyl sulfosuccinate, or a linker co-surfactant such as a monoglyceride, diglyceride, fatty acid or fatty diacid and their use in removing oily and greasy stains;

U.S. Pat. No. 8,172,953 which discloses an ethoxylated, propoxylated extended chain surfactant and its use in combination with alkyl polyglucoside in cleaning compositions; and U.S. Pat. No. 7,467,633 which discloses an extended chain anionic surfactant and a high HLB nonionic surfactant and/or electrolyte and their use in removing grease and oily substances from hard and soft surfaces.

In spite of these state of the art surfactant systems, there is a need to develop new, versatile surfactant systems that provide ultra-low interfacial tension between the oil and water phase which enhances the solublization of hydrophilic and lipophilic molecules.

SUMMARY

In one aspect, there is provided a surfactant blend comprising: (i) an extended chain anionic surfactant; and (ii) an extended chain intermediate surfactant.

In a second aspect, there is provided a cleaning composition containing the surfactant blend of the present disclosure.

In a third aspect, there is provided a single phase microemulsion comprising the surfactant blend of the present disclosure, water and an oil component.

In a fourth aspect, there is provided applications in which the cleaning composition or single phase microemulsion may be useful in including, but not limited to, household cleaner or personal care applications such as in shampoos, hand & body wash, body lotions, body creams, hard surface cleaners, and laundry or dish detergents.

DETAILED DESCRIPTION

If appearing herein, the term "comprising" and derivatives thereof are not intended to exclude the presence of any additional component, step or procedure, whether or not the same is disclosed herein. In order to avoid any doubt, all compositions claimed herein through use of the term "comprising" may include any additional additive, adjuvant, or compound, unless stated to the contrary. In contrast, the term, "consisting essentially of" if appearing herein, excludes from the scope of any succeeding recitation any other component, step or procedure, except those that are not essential to operability and the term "consisting of", if used, excludes any component, step or procedure not specifically delineated or listed. The term "or", unless stated otherwise, refers to the listed members individually as well as in any combination.

The articles "a" and "an" are used herein to refer to one or to more than one (i.e. to at least one) of the grammatical objects of the article. By way of example, "an extended chain surfactant" means one extended chain surfactant or more than one extended chain surfactant. The phrases "in one embodiment", "according to one embodiment" and the like generally mean the particular feature, structure, or characteristic following the phrase is included in at least one embodiment of the present disclosure, and may be included in more than one embodiment of the present disclosure. Importantly, such phrases do not necessarily refer to the same embodiment. If the specification states a component or feature "may", "can", "could", or "might" be included or have a characteristic, that particular component or feature is not required to be included or have the characteristic.

The term "surfactant" means a compound that contains a lipophilic segment and a hydrophilic segment which, when added to water and oil or solvents, reduces the surface tension of the system.

The term "extended chain surfactant" is a surfactant having an intermediate polarity linking chain, such as a block of polypropylene oxide, or a block of polyethylene oxide, or a mixture thereof inserted between the surfactant's conventional lipophilic segment and hydrophilic segment.

The term "electrolyte" refers to a substance that will provide ionic conductivity when dissolved in water or when in contact with it; such compounds may either be solid or liquid.

The term "hard surface" refers to a solid, substantially non-flexible surface such as a counter top, tile, floor, wall, panel, window, plumbing fixture, kitchen and bathroom furniture, appliance, engine, circuit board, and dish.

The term "soft surface" refers to a softer, highly flexible material such as fabric, carpet, hair, and skin.

"Soil" or "stain" refers to a non-polar oily substance which may or may not contain particulate matter such as mineral clays, sand, natural mineral matter, carbon black, graphite, kaolin, environmental dust, etc.

The term "microemulsion" refers to a clear colloidal dispersion that is formed spontaneously or substantially spontaneously when its components are brought into contact with an aqueous medium. A microemulsion is thermodynamically stable and contains dispersed particles of a mean diameter less than about 300 nm, e.g., less than about 250 nm, less than 150 nm, less than 100 nm, and may be greater than about 2-4 nm as measured by standard light scattering techniques.

The term "substantially free" means, when used with reference to the substantial absence of a material, that such a material is present, if at all, as an incidental impurity or by-product. For instance in some embodiments, the material may be present in the composition of matter at an amount of no more than 100 ppm, in some instances less than 20 ppm and in still other instances less than 1 ppm.

According to one aspect, the present disclosure provides a surfactant blend comprising: (i) an extended chain anionic surfactant; and (ii) an extended chain intermediate surfactant. As one skilled in the art knows, extended chain surfactants allow for ultra-low interfacial tension between oil and water phases at the optimum salinity. The salt acts to decrease the water solubility and forces some of the surfactant into the oil phase. As the salt concentration increases, the extended chain surfactant becomes less water soluble and partitions between the oil and water phases. When the interaction on both sides of the interface becomes equal, a minimum in interfacial tension is achieved. It has been surprisingly found that the surfactant blend of the present disclosure is capable of providing an ultra-low interfacial tension between an oil and water phase thus allowing for large amounts of water insoluble oils including, but not limited to, mineral oils, vegetable oils, animal oils, silicone oils, fragrance oils, ethers, esters, etc., to be solubilized without the use of electrolytes (and/or alcohols).

According to one aspect, the surfactant blend includes: (i) an extended chain anionic surfactant of the formula (I)

$$R\text{-}(L)_x\text{-}(O\text{—}CH_2\text{—}CH_2)_y\text{—}O\text{—}SO_3\text{-}A \quad (I)$$

and (ii) an extended chain intermediate surfactant of the formula (II)

$$R\text{-}(L)_x\text{-}(O\text{—}CH2\text{-}CH2)_y\text{—}OH \quad (II)$$

where R is a linear or branched, saturated or unsaturated, substituted or unsubstituted, aliphatic or aromatic hydrocarbon radical having from about 6 to about 36 carbon atoms; L is a linking group, such as a block of polypropylene oxide, or a block of polyethylene oxide, or a mixture thereof; A is any cationic species present for charge neutrality, such as hydrogen or a monovalent or divalent metal cation, such as an alkali metal cation or alkaline earth metal cation, ammonium cation or organic group substituted ammonium cation; x is the average degree of alkoxylation of the linking group L ranging from about 2 to about 20; and y is the average degree of ethoxylation ranging from 0 to about 5.

In one embodiment, R is a linear $C_8$ to $C_{20}$ alkyl chain or a branched $C_8$ to $C_{20}$ alkyl chain. In another embodiment, R is a mixture of linear and branched $C_8$ to $C_{20}$ alkyl chains. In still other embodiments, the number of alkyl branches of R can range from 0 to 7, in further embodiments from 0 to 4 and in still further embodiments from 0 to 3. The branching can occur in any of the carbon atoms ranging from the second carbon atom to the (B-1) carbon atom where B is the number of carbon atoms in the alkyl chain. In one particular embodiment, branching occurs in the second carbon atom. If present, the length of the branches may range from 1 to 8 carbon atoms.

According to another embodiment, A is selected from the group consisting of sodium, potassium, magnesium and ammonium. In another embodiment, A is substituted ammonium, for example, $N^+(CH_3)_4$ or $N^+(C_2H_5)_4$ or $N^+(C_2H_4OH)_4$ or $N^+H_3CH_3$ or $N^+H_2(CH_3)_2$ or $NH^+(CH_3)_3$ or $N^+H(C_2H_4OH)_3$ or $N^+H_2(C_2H_4OH)_2$ or $N^+H_3(C_2H_4OH)$ or $N^+H(CH_3)(C_2H_4OH)_2$. In another embodiment, A is sodium.

In still another embodiment, the average degree of alkoxylation x may range from about 2 to about 18, or from about 3 to about 18, or from about 4 to about 18, or from about 5 to about 18, or from about 6 to about 18, or from about 7 to about 18, or from about 8 to about 18, or from about 9 to about 18 or even from about 10 to about 18.

In still another embodiment, the average degree of ethoxylation y may range from about 1 to about 5, or from about 2 to about 5 or from about 3 to about 5.

In yet another embodiment, the average degree of alkoxylation x+the average degree of ethoxylation y may range from about 6 to about 24, or from about 8 to 22 or even from about 10 to 20.

The extended chain anionic surfactants of formula (I) may be derived, for example, by the propoxylation, ethoxylation and sulfation of an appropriate alcohol, such as a Ziegler, Oxo, Guerbet or natural alcohol of varying chain length and alkyl chain distributions ranging from about 6 to about 36 carbon atoms, and in some embodiments ranging from about 8 to about 20 carbon atoms. Examples of appropriate alcohols include, but are not limited to, commercially available alcohols such as ALFOL® (Vista Chem. Co.), SAFOL® (Sasol Ltd.), NEODOL® (Shell) and LOROL® (BASF) alcohols.

Suitable chemical processes for preparing the extended chain anionic surfactants of formula (I) include the reaction of the appropriate alcohol with propylene oxide and ethylene oxide in the presence of a base catalyst, such as sodium hydroxide, potassium hydroxide, sodium methoxide, potassium methoxide or G2 catalyst, to produce an alkoxylated alcohol. The alkoxylated alcohol is then reacted with sulfamic acid, chlorosulfonic acid, air/$SO_3$, oleum, sulfuric acid, etc. to produce a sour ester which can be neutralized with different bases including sodium hydroxide, potassium hydroxide, monoethanolamine, diethanolamine or triethanolamine to produce the extended chain anionic surfactant.

Similarly, the extended chain intermediate surfactants of formula (II) may be derived by, for example, the propoxylation and ethoxylation of an appropriate alcohol, such as a Ziegler, Oxo or natural alcohol of varying chain length and alkyl chain distributions ranging from about 6 to about 36 carbon atoms, and in some embodiments ranging from about 8 to about 20 carbon atoms. Again, examples of appropriate alcohols include, but are not limited to, commercially available alcohols such as ALFOL® (Vista Chem. Co.), SAFOL® (Sasol Ltd.), NEODOL® (Shell) and LOROL® (BASF) alcohols.

Chemical processes for preparing the extended chain intermediate surfactants of formula (II) include the reaction of the appropriate alcohol with propylene oxide and ethylene oxide in the presence of a base catalyst, such as sodium hydroxide, potassium hydroxide or sodium methoxide.

In one particular embodiment, the appropriate alcohol may first be reacted with propylene oxide and/or ethylene oxide in the presence of a base catalyst to produce the extended chain intermediate surfactant of formula (II) which is then separated into a first and second portion, the first portion being used as the extended chain surfactant of formula (II), while the second portion is reacted with chlorosulfonic acid or $HSO_3Cl$ and then neutralized to produce the extended chain anionic surfactant of formula (I). Thus, the extended chain anionic surfactant of formula (I) and extended chain intermediate surfactant of formula (II) will have the same molecular structure with the exception being the replacement of the hydrogen on the terminal hydroxyl group with a —$SO_3$-A group.

According to another embodiment, the extended chain anionic surfactant of formula (I) and the extended chain intermediate surfactant of formula (II) are combined to form the surfactant blend at a molar ratio which is sufficient to provide a single phase microemulsion when combined with water and a water insoluble oil or solvent. In some embodiments, the molar ratio of the extended chain anionic surfactant of formula (I) to the extended chain intermediate surfactant of formula (II) ranges between about 15:1 to about 1:15, or between about 12:1 to 1:12, or between about 9:1 to about 1:9, or even between about from about 7:1 to about 1:7.

In another embodiment, the surfactant blend consists of the extended chain anionic surfactant of formula (I) and the extended chain intermediate surfactant of formula (II). In one embodiment, the surfactant blend includes a weight % ratio of the extended chain anionic surfactant of formula (I) to the extended chain intermediate surfactant of formula (II) of greater than 1:1, or greater than 1.1:1. In yet another embodiment, the surfactant blend includes a weight % ratio of the extended chain intermediate surfactant of formula (II) to the extended chain anionic surfactant of formula (I) of greater than 1:1, or greater than 1.1:1.

In another aspect, the surfactant blend is provided as an aqueous cleaning composition which can be applied directly to a soiled or stained soft or hard surface. Upon contact, a single phase microemulsion is formed on the surface allowing the oily or greasy substance to become solubilized and removed from the surface. The cleaning composition may comprise from about 1% by weight to about 60% by weight of the surfactant blend and from about 5% to about 99.5% by weight, based on the total weight of the cleaning composition, of water. In other embodiments, the cleaning composition may comprise from about 20% by weight to about 55% by weight, or from about 30% by weight to about 50% by weight of the surfactant blend, the % by weights being based on the total weight of the cleaning composition. In still other embodiments, the cleaning composition contains at least about 5% by weight, or at least about 10% by weight, or even at least about 15% by weight or even still at least about 20% by weight of water, the % by weights being based on the total weight of the cleaning composition In another embodiment, the surfactant blend is provided in the form of, for example, a concentrated cleaning composition, which can be subsequently diluted with water by the user to form a ready to use cleaning composition. The concentrated cleaning composition generally includes between about 5% by weight and about 90% by weight of the surfactant blend and less than about 50% by weight, or less than about 40% by weight, or even less than about 30% by weight of water. Accordingly, the cleaning composition may also be provided to the user as a ready to use cleaning composition in which the concentrated cleaning composition has already been diluted with up to about 95-99% by weight water, based on the total weight of the ready to use cleaning composition.

In addition to the surfactant blend and water, the cleaning composition may also include one or more water insoluble solvents or oils or mixtures thereof herein referred to as an oil component thereby forming a single phase microemulsion. The oil component helps form the single phase microemulsion and at the same time, may acts as a solvent or softener to remove a soil or stain from a surface. The oil component may be provided in an amount ranging between about 0.5% by weight to about 75% by weight, based on the total weight of the single phase microemulsion, or in other embodiments in an amount ranging between about 1% by weight to about 50% by weight, based on the total weight of the single phase microemulsion, and in still another embodiment in an amount ranging between about 2% by weight to about 35% by weight, and in yet another embodiment between about 3% by weight to about 25% by weight, based on the total weight of the single phase microemulsion.

In one embodiment, the oil component may include: an ether such as a glycol ether or a PPG butyl ether; a hydrocarbon or solvent, such as squalane, limonene, liquid paraffin, liquid isoparaffin, a-olefin oligomer, hexadecane, hexane, dipentene, octyl benzene, mineral spirits, mineral oil and the like; a liquid ester, such as isopropyl myristate, octyldodecyl myristate, oleyl oleate, decyl oleate, 2-hexyl decyl isostearate, hexyl decyl dimethyloctanoate, isopropyl palmitate, ethylhexyl palmitate, octyl methoxycinnamate (OMC), hexyl laurate, butyl stearate, diisopropyl adipate and the like; motor oils; a vegetable oil, such as avocado oil, canola oil, almond oil, jojoba oil, olive oil, sesame oil, sasanqua oil, safflower oil, soybean oil, castor oil, *camellia* oil, corn oil, rapeseed oil, rice bran oil, par chic oil, palm kernel oil, palm oil, tea tree oil, sunflower seed oil, grape seed oil, cotton seed oil, hempseed oil, lavender oil and the like; an animal oil, such as turtle oil, mink oil, egg yolk fatty oil, algae oil and the like; and silicone oils, such as dimethylpolysiloxane, methylphenyl polysiloxane, methylhydrogen polysiloxane, octamethylcyclotetrasiloxane and the like; and mixtures thereof.

In one particular embodiment, the single phase microemulsion is substantially free of alcohols. In another embodiment, the single phase microemulsion is substantially free of electrolytes. In still another embodiment, the single phase microemulsion is substantially free of alcohols and electrolytes.

In still another embodiment, the cleaning compositions herein are neutral compositions, and thus have a pH, as is measured at 25° C., of about 6-8, or from about 6.5-7.5, or even about 7. In other embodiments, cleaning compositions herein have a pH above 4 and alternatively have a pH below 10.

Accordingly, the cleaning compositions herein may comprise suitable bases and acids to adjust its pH. Bases which may be used include organic and/or inorganic bases. Examples of such bases are the caustic alkalis, such as sodium hydroxide, potassium hydroxide and/or lithium hydroxide, and/or the alkali metal oxides such, as sodium and/or potassium oxide or mixtures thereof, ammonia, ammonium carbonate, all available carbonate salts such as $K_2CO_3$, $Na_2CO_3$, $CaCO_3$, $MgCO_3$, etc., alkanolamines (as e.g. monoethanolamine), urea and urea derivatives and polyamines. Typical levels of such bases, when present, are from about 0.01% by weight to about 5.0% by weight, or from about 0.05% by weight to about 3.0% by weight and even from about 0.1% by weight to about 0.6% by weight, based on the total weight of the cleaning composition.

Cleaning compositions herein may also comprise an acid to trim its pH to the required level, and despite the acid's presence, the cleaning compositions herein will maintain their pH as described above. Acids for use include organic and/or an inorganic acids. Organic acids may have a pKa of less than 6 and may be selected from the group consisting of citric acid, lactic acid, glycolic acid, succinic acid, glutaric acid, adipic acid and a mixture thereof. Inorganic acids may be selected from the group consisting of hydrochloric acid, sulphuric acid, phosphoric acid and a mixture thereof. A typical level of such an acid, when present, is from about 0.01% by weight to about 5.0% by weight, or from about 0.04% by weight to about 3.0% by weight and even from about 0.05% by weight to about 1.5% by weight, based on the total weight of the cleaning composition.

The cleaning compositions according to the present disclosure may also comprise a variety of auxiliary components depending on the technical benefit aimed for and the surface that is to be treated.

Examples of auxiliary components include antioxidizing agents, suspending aids, chelating agents, co-surfactants, radical scavengers, perfumes, cleaning and surface-modifying polymers, builders, antimicrobial agents, germicides, hydrotropes, colorants, stabilizers, bleaches, bleach activators, suds controlling agents both for suds boosting and suds suppression like fatty acids, enzymes, soil suspenders, anti-corrosion inhibitors, brighteners, anti-dusting agents, dispersants, pigments, dyes, pearlescent agents, rheology modifiers and skin care actives such as emollients, humectants and/or conditioning polymers. Levels of these auxiliary component may range from about 0.00001% by weight up to about 90% by weight, based on the total weight of the cleaning composition.

Antioxidizing agents or preservatives optionally added to the cleaning composition include compounds such as formalin, 5-chloro-2-methyl-4-isothaliazolin-one, and 2,6-di-tert-butyl-p-cresol. Any other conventional antioxidant used in detergent compositions may also be included such as 2,6-di-tert-butyl-4-methylphenol (BHT), carbamate, ascorbate, thiosulfate, monoethanolamine (MEA), diethanolamine, and triethanolamine. When present, these components may be included in amounts ranging from about 0.001% by weight to about 5% by weight, based on the total weight of the cleaning composition.

Corrosion inhibitors and/or anti-tarnish aids, when present, are also incorporated at low levels, for example, from about 0.01% by weight to about 5% by weight, based on the weight of the cleaning composition, and include sodium metasilicate, alkali metal silicates, such as sodium or magnesium silicate, bismuth salts, manganese salts, benzotriazoles, pyrazoles, thiols, mercaptans, aluminum fatty acid salts, and mixtures thereof.

Any optical brightener or brightening agent or bleach may be used in the cleaning compositions of the present disclosure. Typically, brightening agents, when incorporated into the cleaning compositions, are at levels ranging from about 0.01% by weight to about 1.2% by weight, based on the total weight of the cleaning composition. The brightening agents may include derivatives of stilbene, pyrazoline, coumarin, carboxylic acid, methinecyanines, dibenzothiophene-5,5-dioxide, azoles, 5- and 6-membered-ring heterocycles, and other miscellaneous agents. In addition, peroxyacid, perborate, percarbonates and chlorine bleach may be used, generally at levels ranging from about 1% by weight to about 30% by weight, based on the total weight of the cleaning composition. The bleaches may also be used in conjunction with bleach activators, such as amides, imides, esters and anhydrides and/or bleach stabilizers.

Antimicrobial agents which may be present in the cleaning composition include disinfectants such as benzalkonium chloride, polyhexamethylene biguanide, phenolic disinfectants, amphoteric disinfectants, anionic disinfectants, and metallic disinfectants (e.g. silver). Other antimicrobial agents include hydrogen peroxide, peracids, ozone, hypochloride and chlorine dioxide. The amount of antimicrobial agent which may be incorporated into the cleaning composition ranges from about 0.1% by weight to about 10% by weight, based on the total weight of the cleaning composition.

Germicides which may be included are compounds such as copper sulfate. If present, the germicide can range from between about 0.01% by weight to about 5% by weight, based on the total weight of the cleaning composition.

Any suitable organic and inorganic suspending aids typically used as gelling, thickening or suspending agents in cleaning compositions may be used herein. Organic suspending aids include polysaccharide polymers, polycarboxylate polymer thickeners, layered silicate platelets, for example, hectorite, bentonite or montmorillonites, hydroxyl-containing crystalline structuring agents such as a hydroxyl-containing fatty acid, fatty ester or fatty soap wax-like materials such as 12-hydroxystearic acid, 9,10-dihydroxystearic acid, tri-9,10-dihydroxystearin and tri-12-hydroxystearin, castor wax or hydrogenated castor oil. Particular polysaccharide polymers for use herein include substituted cellulose materials like carboxymethylcellulose, ethyl cellulose, hydroxyethylcellulose, hydroxypropylcellulose, hydroxymethylcellulose; micro fibril cellulose (MFC), succinoglycan and naturally occurring polysaccharide polymers like xanthan gum, gellan gum, guar gum and its derivatives, locust bean gum, tragacanth gum, succinoglucan gum, or derivatives thereof. When present, the suspending aid may be used in amounts ranging from about 0.01% by weight to about 10% by weight, based on the total weight of the cleaning composition.

Chelating agents, if present, can be incorporated in the compositions herein in amounts ranging from about 0.01% by weight to about 10.0% by weight, based on the total weight of the cleaning composition. Examples of chelating agents for use herein may include alkali metal ethane 1-hydroxy diphosphonates (HEDP), alkylene poly(alkylene phosphonate), as well as amino phosphonate compounds, including amino aminotri(methylene phosphonic acid) (ATMP), nitrilo trimethylene phosphonates (NTP), ethylene diamine tetra methylene phosphonates, and diethylene triamine penta methylene phosphonates (DTPMP), dihydroxydisulfobenzenes such as 1,2-dihydroxy-3,5-disulfobenzene, ethylene diamine N,N'-disuccinic acid, or alkali metal, or alkaline earth, ammonium or substitutes ammonium salts thereof or mixtures thereof, ethylene diamine tetra acetates, diethylene triamine pentaacetates, diethylene triamine pentaacetate (DTPA), N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms, salicylic acid, aspartic acid, glutamic acid, glycine, malonic acid or mixtures thereof.

Co-surfactants which may be used include nonionic, anionic, zwitterionic, amphoteric, cationic surfactants or mixtures thereof. Examples of suitable surfactants are described in McCutcheon's Vol. 1: Emulsifiers and Detergents, North American Ed., McCutcheon Division, MC Publishing Co., 2002. The compositions herein may comprise from about 0.01% to about 50% by weight, or from about 0.5% to about 40% by weight, or even from about 1% to about 36% by weight, based on the total weight of the cleaning composition of a co-surfactant or a mixture thereof.

Non-limiting examples of non-ionic surfactants include alkyl polysaccharides, amine oxides, fatty acid amides, block copolymers of ethylene oxide and propylene oxide, fluoro surfactants and silicon based surfactants or mixtures thereof.

Non-limiting examples of anionic surfactants for use herein include alkyl sulphonates, alkyl aryl sulphonates, alkyl sulphates, alkyl alkoxylated sulphate surfactants, $C_6$-$C_{20}$ alkyl alkoxylated linear or branched diphenyl oxide disulphonates or mixtures thereof.

Non-limiting examples of amphoteric and zwitterionic surfactants include alkylbetaines, amine oxides, polycarboxylates, alkyl aminopropionic acids, alkyl iminopropionic acids, imidazoline carboxylates, sulfobetaines, and sultaines.

Non-limiting examples of cationic surfactants include primary amine salts, diamine salts, quaternary ammonium salts, ethoxylated amines and mixtures thereof.

Hydrotropes, if present, include, but are not limited to, sodium xylene sulfonate, sodium cumene sulfonate, sodium toluene sulfonate, propylene glycol, glycerol, sorbitol propylene glycol, ethanol and urea. When present, the amount of the hydrotrope present is generally in the range from about 0.5% by weight to about 40% by weight, based on the total weight of the cleaning composition.

Radical scavengers for use herein include the well-known substituted mono and dihydroxy benzenes and their analogs, alkyl and aryl carboxylates and mixtures thereof. Preferred radical scavengers for use herein include di-tert-butyl hydroxy toluene (BHT), hydroquinone, di-tert-butyl hydroquinone, mono-tert-butyl hydroquinone, tert-butyl-hydroxy anysole, benzoicacid, toluicacid, catechol, t-butylcatechol, benzylamine, 1,1,3-tris(2-methyl-4-hydroxy-5-t-butylphenyl) butane, n-propyl-gallate or mixtures thereof and highly preferred is di-tert-butyl hydroxy toluene. Radical scavengers, when used, may be present in the compositions herein in amounts up to about 10% by weight, based on the total weight of the cleaning composition.

Suitable builders can be selected from the group consisting of phosphates and polyphosphates, especially the sodium salts; carbonates, bicarbonates, sesquicarbonates and carbonate minerals other than sodium carbonate or sesquicarbonate; organic mono-, di-, tri-, and tetracarboxylates especially water-soluble nonsurfactant carboxylates in acid, sodium, potassium or alkanolammonium salt form, as well as oligomeric or water-soluble low molecular weight polymer carboxylates including aliphatic and aromatic types; and inorganic builders such as sulfates, citrate, zeolite, aluminosilicates, and phytic acid. These may be complemented by borates, e.g., for pH-buffering purposes, or by sulfates, especially sodium sulfate and any other fillers or carriers which may be important to the engineering of stable surfactant and/or builder-containing detergent compositions. Builder mixtures, sometimes termed "builder systems" can also be used and typically comprise two or more conventional builders, optionally complemented by chelants, pH-buffers or fillers, though these latter materials are generally accounted for separately when describing quantities of materials herein. When present, builders comprise from about 1% by weight to about 90% by weight, based on the total weight of the cleaning composition.

Suitable colors and fragrances are well known to those skilled in the art. Colors include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), and Acid Green 25 (Ciba-Geigy). Examples of fragrances include natural products such as ambergris, benzoin, castoreum, civet, clove oil, *galbanum*, jasmine, rosemary oil, sandalwood, orange oil, lemon oil, rose extract, lavender, musk, pine oil, cedar and the like. Examples of aroma chemicals include, but are not limited to, isoamyl acetate (banana); isobutyl propionate (rum); methyl anthranilate (grape); benzyl acetate (peach); methyl butyrate (apple); ethyl butyrate (pineapple); octyl acetate (orange); n-propyl acetate (pear); and ethyl phenyl acetate (honey). The cleaning compositions according to this disclosure can contain any combination of the above types of compounds in an effective amount necessary to produce an odor masking effect or reduce an unwanted odor to an acceptable level and in some embodiments, the oils and esters listed above may be used as the oil component. The amounts used can be readily determinable by those skilled in the art and can range from about 0.01% by weight to about 5% by weight, based on the total weight of the cleaning composition.

Polymeric suds stabilizers may be selected from homopolymers of (N,N-dialkylamino)alkyl esters and (N,N-dialkylamino)alkyl acrylate esters and hydrophobically modified cellulosic polymers including methylcellulose, hydroxypropyl methylcellulose, hydroxyethyl methylcellulose, and mixtures thereof. The amount of the polymeric suds stabilizer may range from about 0.01% by weight to about 15% by weight, based on the total weight of the cleaning composition.

If desired, enzymes may be included in the cleaning composition to provide cleaning performance benefits. The enzymes, when present, range from about 0.0001% by weight to about 5% by weight of active enzyme, based on the total weight of the cleaning composition, and include one or a mixture of cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, beta-glucanases, and arabinosidases.

When enzymes are present, enzyme stabilizers may also be included in the cleaning compositions in an amount ranging from about 0.001% by weight to about 10% by weight of total weight of the cleaning composition. Enzyme stabilizers are compounds that are compatible with the enzymes and include calcium ion, boric acid, propylene glycol, short chain carboxylic acids, boronic acids, and mixtures thereof. For example, boric acid salt, such as an alkali metal borate or amine (e.g. an alkanolamine) borate, or an alkali metal borate, or potassium borate, calcium chloride, calcium hydroxide, calcium formate, calcium malate, calcium maleate, calcium hydroxide and calcium acetate are enzyme stabilizers which may be used in the cleaning compositions of the present invention To make the compositions herein, the components above are combined together by means well known in the art. The relative levels of the components are selected to give the required performance of the composition in a hard surface or soft surface cleaning application, with an eye toward making sure on the one hand that a component is present at a sufficient level to be effective, but on the other hand that excessive cost is avoided by limiting the upper range of the component.

Because the compositions herein are generally prepared as liquid formulations, and since no particular mixing is required to form the single phase microemulsion, the compositions may be easily prepared in any suitable vessel or container. The order of mixing the components is not particularly important and generally the various components can be added sequentially or all at once in the form of aqueous solutions.

Surprisingly, microemulsion formation from the above components proceeds spontaneously due to the favorable free energy of formation as the components are mixed together. Although microemulsions are thermodynamically favored, kinetic barriers may in some instances impede their formation. Accordingly, the application of moderate increases in mixing energy or temperature can be applied if necessary to overcome such kinetic barriers in the formation of the microemulsion.

Once formulated, the compositions of the present disclosure can be packaged in a variety of containers such as steel, tin, or aluminum cans, plastic or glass bottles and paper or cardboard containers.

In addition to the cleaning compositions described above (which are produced by mixing the desired components together), the cleaning compositions of the present disclosure may also be formulated as a bar by using a binding agent to hold the bar together in a cohesive, soluble form. The binding agent may be natural or synthetic starch, gum, thickener, or any mixtures thereof. Furthermore, the cleaning composition may be formulated as a paste or gel by the addition of a thickening or gelling agent such as fumed silica, organic gums, polymers, paraffin wax, bentonite clay and cellulose ethers.

In another embodiment, the cleaning composition of the present disclosure is provided as a low to moderate bulk density powder. The low to moderate bulk density powder may be prepared by spray-drying a liquid slurry comprising a cleaning composition of the present invention and optionally dry-mixing further ingredients. In another embodiment, the low to moderate bulk density powder is concentrated or compacted by mixing and granulating the powder composition using a high-speed mixer/granulator, or other non-tower drying process. In yet another embodiment tablets may be prepared by compacting concentrated powders comprising the cleaning composition of the present disclosure.

The cleaning compositions of the present disclosure may be used in a variety of applications and in one particular embodiment are especially suitable for cleaning hard surfaces or soft surfaces.

Thus, in another aspect, the present disclosure provides a method of removing a soil or stain from a hard surface or soft surface. A standard means of treatment is to contact or apply the cleaning composition according to the present disclosure to or against a hard surface or soft surface in a variety of application means, for example, spraying, such as in aerosol form or by standard spray nozzles, rubbing, scraping, brush application, dipping, coating, application in gel form, or pouring the cleaning composition on or against the hard surface or soft surface. The cleaning composition may then be removed from the hard surface or soft surface by rinsing with water and/or wiping until the cleaning composition is no longer visible to the eye. The hard or soft surface may also be air-dried to remove the cleaning composition or remaining water from the surface.

While the surfactant blends are especially useful in cleaning compositions, they have also been found to be highly versatile and may be included in aqueous compositions or microemulsions for use in oil field applications, water based metal working applications, polyurethane foam applications, or in cosmetic and dermatological applications.

Thus, in another embodiment, there is a provided a personal care composition comprising the surfactant blend of the present disclosure and water. "Personal care" relates to compositions to be topically applied to a person's hair or skin, but not ingested orally. Preferably, the personal care compositions are to be topically applied to a person's skin during rinse-off applications. Contemplated are personal care compositions comprising the surfactant blend which include body-washes, shower gels, exfoliating compositions, shampoos, rinse-off conditioners, shaving foams, face washes, cleansers, hand washes, cleansing creams/milks, astringent lotions, skin toners or fresheners, bubble baths, soluble bath oils, and bar soaps.

According to some embodiments, the personal care composition comprises 0.05% by weight or greater, optionally 0.1% by weight or greater, of the surfactant blend, where the % by weight is based on the total weight of the personal care composition. In another embodiment, the personal care composition comprises 10% by weight or less, or 5% by weight or less, of the surfactant blend, where the % by weight is based on the total weight of the personal care composition.

Other components (and their amounts) which may be included in the personal care composition are well known to those skilled in the art and may include those listed above. For example, other components that may be included are a humectant, a preservative, a pH adjuster, a moisturizer and/or an anti-irritant, such as aloe vera, PEG-7 glyceryl cocoate, Chamomile, avocado oil or sweet almond oil, a dye or a perfume.

In yet another embodiment, there is provided a lubricating oil concentrate useful in metal forming or cutting applications which comprises the surfactant blend of the present disclosure and a base oil, such as a petroleum-based oil, vegetable oil, animal-derived oil or synthetic oil. Lubricating oils formulations and their components/amounts are described in US 20150051132, the entire contents of which is incorporated herein by reference.

In one particular embodiment, the lubricating oil concentrate may be dispersed in an aqueous medium and used in a cutting process. The lubricating oil concentrate formulation may be dispersed in an aqueous medium at a concentration of about 5 weight parts to 20 weight parts of oil concentrate per 100 weight parts of aqueous medium (for e.g. water) and may include the following:

| Oil Concentrate Components | Wt. % based on the total weight of oil concentrate |
|---|---|
| Base Oil | 60 to 75 |
| Surfactant Blend of the present disclosure | 10 to 18 |
| Diglycolamine | 3 to 6 |
| Inorganic Acid | 1 to 4 |
| Organic Acid | 1 to 2 |
| Stabilizer | 2 to 4 |
| Tall Oil Fatty Acid | 6 to 10 |
| Deionized Water | 0.5 to 3 |

In another embodiment, the lubricating oil concentrate may be dispersed in an aqueous medium and used for an aluminum cutting or grinding process. The lubricating oil concentrate formulation for an aluminum cutting or grinding process may be dispersed in an aqueous medium at a concentration of about 5 weight parts to about 20 weight parts of oil concentrate per 100 parts of aqueous medium (for e.g. water) and may include the following:

| Oil Concentrate Components | Wt. % based on the total weight of the oil concentrate |
|---|---|
| Base Oil | 5 to 20 |
| Surfactant Blend of the present disclosure | 10 to 20 |
| Nonionic Surfactants | 0 to 15 |
| Tall Oil | 6 to 10 |
| Stabilizer | 1 to 3 |
| Diglycolamine | 5 to 10 |
| Inorganic Acid | 3 to 5 |
| Organic Acid | 1 to 3 |
| Amine | 0.2 to 0.6 |
| Deionized Water | Balance to 100 |

EXAMPLES

Example 1. Preparation of Microemulsions Using Various Oils

The following tables identify the components that were combined to form single phase microemulsions using various oils:

TABLE 1

(Avocado Oil/examples of a moisturizer formulation for personal care)

| Component | 1A | 1B |
|---|---|---|
| Extended Chain Surfactant[1] | 32 g | 37 g |
| Extended Chain Intermediate Surfactant | 14 g | 16.9 g |
| Sodium Xylene Sulfonate (40%) | 10 g | 17 g |
| Avocado Oil | 20 g | 21.6 g |
| Glycerin | 10 g | 12.5 g |
| Propylene Glycol | — | 5 g |
| Water | 20 g | 23 g |

[1]Sodium PPG-16/PEG-2 laureth sulfate
[2]L24-16PO-2EO intemediate

TABLE 2

(Silicone Oil/examples of hair conditioning or leather treatment formulations)

| Component | 2A (% w/w) | 2B (% w/w) | 2C (% w/w) | 2D (% w/w) | 2E (% w/w) |
|---|---|---|---|---|---|
| Ext. Chain Surfactant[1] | 17.1 | 17.7 | 17.3 | 16.3 | 16.6 |
| Ext. Chain Intermediate Surfactant[2] | 20.1 | 18.6 | 20.2 | 21 | 19.8 |
| Sodium Xylene Sulfonate (40%) | 9.6 | 17.7 | 17.3 | 9.3 | 9.7 |
| Silicone Oil | 18.2 | 17.5 | 17.6 | 17.4 | 13.9 |
| Propylene Glycol | 6.4 | 6.9 | 6.8 | 8 | 8.3 |
| Glycerin | 7.4 | 4.9 | 2.9 | 7 | 6.2 |
| Water | 21.2 | 16.7 | 17.9 | 21 | 25.5 |

[1]EMPICOL ® PES 101 surfactant (sodium PPG-16/PEG-2 laureth sulfate)
[2]L24-16PO-2EO intermediate

TABLE 3

(Vegetable Oil/examples of a moisturizer formulation)

| Component | 3A (% w/w) | 3B (% w/w) | 3C (% w/w) | 3D (% w/w) |
|---|---|---|---|---|
| Ext. Chain Surfactant[1] | 23 | 28 | 21 | 18.5 |
| Ext. Chain Intermediate Surfactant[2] | 19 | 22.7 | 21.4 | 17.7 |
| Sodium Xylene Sulfonate (40%) | 10 | 12 | 13.7 | 14.8 |
| Jojoba Oil | | 20 | | |
| Sweet Almond Oil | 16.5 | | | |
| Grapeseed Oil | | | 17 | |
| Hempseed Oil | | | | 14.5 |
| Propylene Glycol | 8 | 8 | 6 | 8.7 |
| Glycerin | 8 | 10 | 7.7 | 8.8 |
| Water | 15.5 | 19.3 | 13.2 | 17 |

[1]EMPICOL ® PES 101 surfactant (sodium PPG-16/PEG-2 laureth sulfate)
[2]L24-16PO-2EO intermediate

TABLE 4

(Mink Oil/examples of leather treatment formulation)

| Component | 4A |
|---|---|
| Ext. Chain Surfactant[1] | 20 g |
| Ext. Chain Intermediate Surfactant[2] | 19 g |
| Sodium Xylene Sulfonate (40%) | 15.5 g |
| Mink Oil | 15.5 g |
| Propylene Glycol | 8.6 g |
| Glycerin | 8.6 g |
| Water | 10.3 g |
| Polysorbate 20 | 1.7 g |

[1]EMPICOL ® PES 101 surfactant (sodium PPG-16/PEG-2 laureth sulfate)
[2]L24-16PO-2EO intermediate

TABLE 5

(Rice Bran Oil, Castor Oil/examples of anti-oxidant sprays)

| Component | 5A (% w/w) | 5B (% w/w) |
|---|---|---|
| Ext. Chain Surfactant[1] | 15.4 | 19 |
| Ext. Chain Intermediate Surfactant[2] | 22.7 | 20 |
| Sodium Xylene Sulfonate (40%) | 13.5 | 17 |
| Rice Bran Oil | 19 | |
| Castor Oil | | 18 |
| Propylene Glycol | 6.7 | |
| Glycerin | 7.7 | 13 |
| Water | 15 | 13 |

[1]EMPICOL ® PES 101 surfactant (sodium PPG-16/PEG-2 laureth sulfate)
[2]L24-16PO-2EO intermediate

TABLE 6

(Sunflower Oil/example of a metal working formulation)

| Component | 6A |
|---|---|
| Ext. Chain Surfactant[1] | 18 g |
| Ext. Chain Intermediate Surfactant[2] | 18.9 g |
| Sodium Xylene Sulfonate (40%) | 16.2 g |
| Sunflower Oil | 18 g |
| Propylene Glycol | 7.2 g |
| Glycerin | 8 g |
| Water | 13.5 g |

[1]EMPICOL ® PES 101 surfactant (sodium PPG-16/PEG-2 laureth sulfate)
[2]L24-16PO-2EO intermediate

TABLE 7

(Ether, Ester/examples of emollients)

| Component | 7A (% w/w) | 7B (% w/w) | 7B (% w/w) |
|---|---|---|---|
| Ext. Chain Surfactant[1] | 17.7 | 18.2 | 19 |
| Ext. Chain Intermediate Surfactant[2] | 20.6 | 20 | 22 |
| Sodium Xylene Sulfonate (40%) | 22.5 | 10.9 | 24 |
| PPG14 Butyl Ether | 11.5 | | |
| Diisopropyl Adipate | | 13.6 | |
| OMC | | | 8 |
| Propylene Glycol | 8 | 9 | |
| Glycerin | 7.4 | 8.2 | 12 |
| Water | 10.9 | 16.5 | 15 |
| Polysorbate 20 | 1 | 3.6 | |

[1]EMPICOL ® PES 101 surfactant (sodium PPG-16/PEG-2 laureth sulfate)
[2]L24-16PO-2EO intermediate

TABLE 8

(Ether, Ester/examples of emollients and moisturizer formulations)

| Component | 8A (% w/w) | 8B (% w/w) |
|---|---|---|
| Ext. Chain Surfactant[1] | 17.7 | 18.2 |
| Ext. Chain Intermediate Surfactant[2] | 20.6 | 20 |
| Sodium Xylene Sulfonate (40%) | 22.9 | 10.9 |
| PPG14 Butyl Ether | 11.5 | |
| Diisopropyl Adipate | | 13.6 |
| Propylene Glycol | 8 | 9 |
| Glycerin | 7.4 | 8.2 |
| Water | 10.9 | 16.5 |
| Polysorbate 20 | 1 | 3.6 |

[1]EMPICOL ® PES 101 surfactant (sodium PPG-16/PEG-2 laureth sulfate)
[2]L24-16PO-2EO intermediate

TABLE 9

(Canola Oil, Ester)

| Component | 9A (% w/w) | 9B (% w/w) |
|---|---|---|
| Ext. Chain Surfactant[1] | 28 | 19 |
| Ext. Chain Intermediate Surfactant[2] | 23 | 21.6 |
| Sodium Xylene Sulfonate (40%) | 12 | 18 |
| Canola Oil | | 15 |
| Ethylhexyl Palmitate | 20 | |
| Propylene Glycol | 10 | 6.7 |
| Glycerin | 10 | 7 |
| Water | 18 | 12.7 |

[1]EMPICOL ® PES 101 surfactant (sodium PPG-16/PEG-2 laureth sulfate)
[2]L24-16PO-2EO intermediate

TABLE 10

(Vegetable Oil, Silicone Oil)

| Component | 10A (% w/w) | 10B (% w/w) | 10C (% w/w) | 10D (% w/w) |
|---|---|---|---|---|
| Ext. Chain Surfactant[1] | 23 | 25 | 18.5 | 15.6 |
| Ext. Chain Intermediate Surfactant[2] | 14 | 15 | 17.7 | 22 |
| Sodium Xylene Sulfonate (40%) | 14 | 10 | 14.8 | 14.2 |
| Silicone Oil (100 cst) | | 3 | | |
| Lavender Oil | 15 | | | |

TABLE 10-continued (Vegetable Oil, Silicone Oil)

| Component | 10A (% w/w) | 10B (% w/w) | 10C (% w/w) | 10D (% w/w) |
|---|---|---|---|---|
| Rice Bran Oil | | | | 16.6 |
| Hempseed Oil | | | 14.5 | |
| Avocado Oil | | 17 | | |
| Propylene Glycol | 11 | 4 | 8.7 | 7.6 |
| Glycerin | 5 | 9 | 8.8 | 8.3 |
| Water | 18 | 17 | 17 | 15.7 |

[1]EMPICOL ® PES 101 surfactant (sodium PPG-16/PEG-2 laureth sulfate)
[2]L24-16PO-2EO intermediate

TABLE 11

(Vegetable Oil)

| Component | 11A (% w/w) | 11B (% w/w) | 11C (% w/w) | 11D (% w/w) |
|---|---|---|---|---|
| Ext. Chain Surfactant[1] | 21 | 17.6 | 18.5 | 15.6 |
| Ext. Chain Intermediate Surfactant[2] | 21.4 | 19.8 | 17.7 | 22 |
| Sodium Xylene Sulfonate (40%) | 13.7 | 18 | 14.8 | 14.2 |
| Grapeseed Oil | 17 | | | |
| Rice Bran Oil | | | | 16.6 |
| Hempseed Oil | | | 14.5 | |
| Avocado Oil | | 15 | | |
| Propylene Glycol | 6 | 7 | 8.7 | 7.6 |
| Glycerin | 7.7 | 9 | 8.8 | 8.3 |
| Water | 13.2 | 13.6 | 17 | 15.7 |

[1]EMPICOL ® PES 101 surfactant (sodium PPG-16/PEG-2 laureth sulfate)
[2]L24-16PO-2EO intermediate

TABLE 12

(Algae Oil)

| Component | 12A (% w/w) | 12B (% w/w) | 12C (% w/w) |
|---|---|---|---|
| Ext. Chain Surfactant[1] | 26 | 26 | 26.3 |
| Ext. Chain Intermediate Surfactant[2] | 23.8 | 23.7 | 24.6 |
| Sodium Xylene Sulfonate (40%) | 23.7 | 23.7 | 23 |
| Algae Oil | 7 | 6.6 | 7.4 |
| Water | 19.5 | 20 | 18.7 |

[1]EMPICOL ® PES 101 surfactant (sodium PPG-16/PEG-2 laureth sulfate)
[2]L24-16PO-2EO intermediate

TABLE 13

(Mink Oil/example of leather treatment formulation)

| Component | 13A |
|---|---|
| Ext. Chain Surfactant[1] | 80 g |
| Ext. Chain Intermediate Surfactant[2] | 134 g |
| Sodium Xylene Sulfonate (40%) | 102 g |
| Mink Oil | 34 g |
| Albrite Leather | 4 g |
| SLES (ESB 70) | 4 g |
| Water | 76 g |

[1]EMPICOL ® PES 101 surfactant (sodium PPG-16/PEG-2 laureth sulfate)
[2]L24-16PO-2EO intermediate

TABLE 14

(Tea Tree Oil/examples of disinfectant formulations)

| Component | 14A (% w/w) | 14B (% w/w) |
|---|---|---|
| Ext. Chain Surfactant[1] | 24 | 25 |
| Ext. Chain Intermediate Surfactant[2] | 29 | 25 |
| Sodium Xylene Sulfonate (40%) | 29 | 25 |
| Tea Tree Oil | 4.4 | 7 |
| Ethanol | | 5.6 |
| Water | 13.6 | 12.4 |

[1]EMPICOL ® PES 101 surfactant (sodium PPG-16/PEG-2 laureth sulfate)
[2]L24-16PO-2EO intermediate Example 2. Detergency Effects The detergency of the surfactant blend is shown below in Tables 15 and 16 for polyester and polyester/cotton samples:

TABLE 15

Pretreatment

| Surfactant Blend[1] (Wt. Ratio) | Detergency (Delta E) Polyester | Detergency (Delta E) Polyester/ Cotton | Detergency (Delta E) Total |
|---|---|---|---|
| 100:0 | 3 | 7 | 10 |
| 66.7:33.3 | 7 | 16 | 23 |
| 50:50 | 7.5 | 16 | 23.5 |
| 33.3:66.7 | 9 | 16.5 | 25.5 |
| 0:100 | 10 | 15.5 | 25.5 |

[1]EMPICOL ® PES 101 surfactant (sodium PPG-16/PEG-2 laureth sulfate): L24-16PO-2EO intermediate.

TABLE 16

In Wash

| Surfactant Blend[1] (Wt. Ratio) | Detergency (Delta E) Polyester | Detergency (Delta E) Polyester/ Cotton | Detergency (Delta E) Total |
|---|---|---|---|
| 100:0 | 45 | 52 | 97 |
| 48:52 | 46 | 55 | 101 |
| 26:74 | 49 | 58 | 107 |
| 13:87 | 49 | 54 | 103 |
| 0:100 | 46 | 47 | 93 |

[1]EMPICOL ® PES 101 surfactant (sodium PPG-16/PEG-2 laureth sulfate): L24-16PO-2EO intermediate.

While the foregoing is directed to embodiments of the present disclosure, other and further embodiments of the disclosure may be devised without departing from the basic scope thereof, and the scope thereof is determined by the claims that follow.

The invention claimed is:

1. An aqueous composition consisting of:

(i) an extended chain anionic surfactant of formula (I)

R-(L)*x*-(O—CH2-CH2)*y*-O—SO3-A (I) and (ii) an extended chain intermediate surfactant of formula (II)

R-(L)*x*-(O—CH2-CH2)*y*-OH (II)

wherein: R in the extended chain anionic surfactant of formula (I) is a linear or branched, saturated or unsaturated, substituted or unsubstituted, aliphatic or aromatic hydrocarbon radical having from about 6 to about 36 carbon atoms and R in the extended chain intermediate surfactant of formula (II) is a linear or branched, saturated or unsaturated, substituted or unsubstituted, aliphatic or aromatic hydrocarbon radical having from about 6 to about 36 carbon atoms;

L is a linking group comprising a block of polypropylene oxide;

A is selected from hydrogen, a monovalent metal cation, a divalent metal cation, ammonium cation and an organic group substituted ammonium cation;

x is the average degree of alkoxylation of the linking group L ranging from about 2 to about 20; and y is the average degree of ethoxylation ranging from 1 to about 5, and the sum of x and y is in a range of from 6 to 24, (iii) water, and optionally (iv) one or more auxiliary components selected from: an inorganic base; an organic base; an antioxidizing agent selected from formalin, 5-chloro-2-methyl-4-isothaliazolin-one, 2,6-di-tert-butyl-p-cresol, 2,6-di-tert-butyl-4-methylphenol, carbamate, ascorbate, thiosulfate, monoethanolamine, diethanolamine, and triethanolamine; a corrosion inhibitor selected from sodium metasilicate, an alkali metal silicate, a bismuth salt, a manganese salt, benzotriazole, pyrazole and mercaptan; an optical brightener selected from stilbene, pyrazoline, coumarin, a methinecyanine, dibenzothiophene-5,5-dioxide, and an azole; an antimicrobial agent selected from benzalkonium chloride, polyhexamethylene biguanide, hydrogen peroxide, ozone, hypochloride, and chlorine dioxide; copper sulfate; a suspending aid selected from a polysaccharide polymer, a polycarboxylate polymer thickener, a layered silicate platelet, castor wax, carboxymethylcellulose, ethyl cellulose, hydroxyethylcellulose, hydroxypropylcellulose, hydroxymethylcellulose; micro fibril cellulose, succinoglycan, xanthan gum, gellan gum, guar gum, locust bean gum, tragacanth gum and succinoglucan gum; a chelating agent selected from an alkali metal ethane 1-hydroxy diphosphonate, an alkylene poly(alkylene phosphonate), an amino phosphonate compound, a radical scavenger selected from di-tert-butyl hydroxy toluene, hydroquinone, di-tert-butyl hydroquinone, mono-tert-butyl hydroquinone, tert-butyl-hydroxy anysole, catechol, t-butylcatechol, benzylamine, 1,1,3-tris (2-methyl-4-hydroxy-5-t-butylphenyl) butane and n-propyl-gallate; a colorant selected from Direct Blue 86, Fastusol Blue, Acid Orange 7, Basic Violet 10, Acid Yellow 23, Acid Yellow 17, Sap Green, Metanil Yellow, Acid Blue 9, Sandolan Blue/Acid Blue 182, Hisol Fast Red, Fluorescein, and Acid Green 25; a fragrance selected from ambergris, benzoin, castoreum, civet, clove oil, *galbanum*, jasmine, rosemary oil, sandalwood, orange oil, lemon oil, rose extract, lavender, musk, pine oil, and cedar; and an enzyme selected from a cellulase, a hemicellulase, a peroxidase, a protease, a gluco-amylase, an amylase, a lipase, a cutinase, a pectinase, a xylanase, a reductase, an oxidase, a phenoloxidase, a lipoxygenase, a ligninase, a pullulanase, a tannase, a pentosanase, a malanase, a beta-glucanase, and an arabinosidase.

2. The composition of claim 1, wherein R in the extended chain anionic surfactant of formula (I) is a linear C8 to C20 alkyl chain or a branched C8 to C20 alkyl chain or a mixture thereof.

3. The composition of claim 1, wherein A is selected from the group consisting of sodium, potassium, magnesium and ammonium.

4. A single phase microemulsion comprising the aqueous composition of claim 1 and an oil component selected from an ether, a liquid ester, a mineral oil, a vegetable oil, an animal oil, and a mixture thereof.

5. The single phase microemulsion of claim 4, wherein the surfactant blend is present in an amount ranging from about 1% by weight to about 60% by weight, based on the total weight of the single phase microemulsion.

6. The single phase microemulsion of claim 4, wherein the oil component is present in an amount ranging from about 0.5% by weight to about 75% by weight, based on the total weight of the single phase microemulsion.

7. The single phase microemulsion of claim 4, further comprising the auxiliary component.

8. The single phase microemulsion of claim 4, wherein the single phase microemulsion is substantially free of electrolytes.

9. A method for producing a single phase microemulsion comprising mixing the composition of claim 1 with an oil component.

10. A method of removing a soil or stain from a hard surface or soft surface comprising contacting the composition of claim 1 and the hard surface or soft surface.

11. An aqueous composition consisting of:

(i) an extended chain anionic surfactant of formula (I)

R-(L)*x*-(O—CH2-CH2)*y*-O—SO3-A (I) and (ii) an extended chain intermediate surfactant of formula (II)

R-(L)*x*-(O—CH2-CH2)*y*-OH (II)

wherein: R in the extended chain anionic surfactant of formula (I) is a linear or branched, saturated or unsaturated, substituted or unsubstituted, aliphatic or aromatic hydrocarbon radical having from about 6 to about 36 carbon atoms and R in the extended chain intermediate surfactant of formula (II) is a linear or branched, saturated or unsaturated, substituted or unsubstituted, aliphatic or aromatic hydrocarbon radical having from about 6 to about 36 carbon atoms;

L is a linking group comprising a block of polypropylene oxide or a mixture of polyethylene oxide and polypropylene oxide;

A is selected from hydrogen, a monovalent metal cation, a divalent metal cation, ammonium cation and an organic group substituted ammonium cation;

x is the average degree of alkoxylation of the linking group L ranging from about 2 to about 20; and y is the average degree of ethoxylation ranging from 1 to about 5, (iii) from about 95% by weight to about 99.5% by weight, based on the total weight of the composition, of water, and (iv) optionally an auxiliary component selected from a water insoluble solvent, a base, an antioxidizing agent, a suspending aid, a chelating agent, a radical scavenger, a cleaning and surface-modifying polymer, a builder, an antimicrobial agent, a germicide, a hydrotrope, a colorant, a stabilizer, bleach, a bleach activator, a suds controlling agent, an enzyme, a soil suspender, an anti-corrosion inhibitor, a brightener, an anti-dusting agent, a dispersant, a pigment, a dye, a pearlescent agent, a rheology modifier, a skin care active and a mixture thereof.

12. A single phase microemulsion comprising the composition of claim 11, and an oil component.

* * * * *